US006565273B2

(12) United States Patent
Yamada

(10) Patent No.: US 6,565,273 B2
(45) Date of Patent: May 20, 2003

(54) PRINTER THAT ACCOMODATES ROLLED PAPER HAVING VARIOUS WIDTHS

(75) Inventor: Masahiko Yamada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 39 days.

(21) Appl. No.: 09/836,556

(22) Filed: Apr. 18, 2001

(65) Prior Publication Data

US 2002/0021930 A1 Feb. 21, 2002

(30) Foreign Application Priority Data

Apr. 19, 2000 (JP) ..... 2000-118145

(51) Int. Cl.[7] ..... B41J 17/22; B41J 11/48; B41J 17/00; B41L 47/46

(52) U.S. Cl. ..... 400/512; 400/594; 400/611; 400/619; 107/92; 107/288; 347/215

(58) Field of Search ..... 400/512, 582, 400/594, 708, 693, 611, 613, 621; 101/92, 288; 347/215

(56) References Cited

U.S. PATENT DOCUMENTS 3,476,230 A 11/1969 Hunter
4,179,077 A 12/1979 Morishita
6,065,884 A * 5/2000 Parker et al. ..... 400/611

FOREIGN PATENT DOCUMENTS

| | | |
|---|---|---|
| JP | 63-52851 | 4/1988 |
| JP | 2-137356 | 11/1990 |
| JP | 4-29868 | 1/1992 |
| JP | 4-133647 | 12/1992 |
| JP | 5-32350 | 4/1993 |
| JP | 10-181130 | 7/1998 |

* cited by examiner

*Primary Examiner*—Andrew H. Hirshfeld
*Assistant Examiner*—Marvin P. Crenshaw
(74) *Attorney, Agent, or Firm*—Nixon & Vanderhye P.C.

(57) ABSTRACT

A printer that is able to accommodate rolled papers of different widths. The printer includes a rolled-paper holder and a partitioning member. The rolled-paper holder includes a bottom wall having a first contact bottom portion and a second contact bottom portion, a first contact side wall, and a second contact side wall, wherein the sidewalls are substantially parallel to each other. The partitioning member includes a third contact side portion arrangeable in parallel to the first contact side wall and the second contact side wall, a third contact bottom portion that is brought into elastic contact with the bottom wall at a predetermined elasticity and may be stopped there by engagement, and a coupling portion that may be coupled to the second contact side wall.

11 Claims, 8 Drawing Sheets

PRINTER THAT ACCOMODATES ROLLED PAPER HAVING VARIOUS WIDTHS

BACKGROUND OF THE INVENTION

1. Field of the Invention

The present invention relates to a printer for printing on a rolled-paper recording sheet or the like by a thermal printing method. More particularly, the invention relates to a printer with a rolled-paper holder capable of supporting rolled papers of different widths.

2. Discussion of the Related Art

Generally, this type of the printer includes a rolled-paper holder that is shaped like a box that receives a rolled paper. A recording paper is fed from the rolled-paper holder on and along a transporting path.

The related art rolled-paper holder is sized so as to receive a rolled paper having a prescribed width. However, it is often necessary to use a rolled paper whose width is smaller than the prescribed size.

To cope with this, there is an approach to enable the rolled-paper holder to flexibly hold rolled paper of different width values. In this approach, a partitioning member is set at a predetermined location within the rolled-paper holder thereby securing a space of a desired size within the sheet holder.

However, in the related art printer, when the partitioning member is set within the rolled-paper holder, the partitioning member is frequently set in a state wherein it rises above the bottom of the rolled-paper holder, or in a state wherein it is oblique to the side walls of the rolled-paper holder.

Accordingly, the related art printer suffers from the following problems. A recording sheet rolled out of the rolled paper is caught in a gap that is formed between the partitioning member and the rolled-paper holder. Also, the side face of the rolled paper comes in contact with the oblique partitioning member and, hence, the recording sheet rolled out is also oblique. In the related art printer that merely uses the partitioning member, when the partitioning member is used for holding the rolled paper, the rolled-paper holder cannot support the rolled paper in the same state as when the partitioning member is not used.

SUMMARY OF THE INVENTION

Accordingly, an object of the invention is to provide a printer with a rolled-paper holder that is able to support rolled papers of different width values in a like and stable state.

1. Manner of Solving the Problems

To achieve the above object, there is provided a printer comprising:

a print mechanism for printing characters on a recording sheet rolled out of a rolled paper;

a rolled-paper holder including a bottom wall having a first contact bottom portion and a second contact bottom portion that support a first rolled paper while being in contact with a part of a circumferential outer surface of said first rolled paper and, a first contact side wall and a second contact side wall, which are located on opposite sides of said bottom wall and which are substantially parallel to each other, wherein the first contact side wall and the second contact side wall may come in contact with a side face of said first rolled paper;

a partitioning member being locatable between said first contact side wall and said second contact side wall of said rolled-paper holder, said partitioning member includes a third contact side wall which may come in contact with a second rolled paper whose width is narrower than that of said first rolled paper, and a third contact bottom portion which is provided on said third contact side wall in a direction substantially perpendicular to said third contact side wall; and a coupling mechanism enabling said partitioning member to be set in said rolled-paper holder such that said first contact side wall and said third contact side wall are substantially parallel to each other while being spaced from each other by a predetermined distance.

In the printer thus constructed, the partitioning member includes the third contact side portion and the third contact bottom portion. Accordingly, when the partitioning member is set in the rolled-paper holder, it rises to the bottom portion of the rolled-paper holder, and no gap is formed between the third contact side portion and the third contact bottom portion. The printer is free from the problem wherein a recording sheet rolled out of the rolled paper is caught in a gap. For the third contact side portion and the third contact bottom portion, the outer surface of the rolled paper is supported in the same state.

In the printer, the coupling mechanism may include engaging portion which selectively set a spatial interval between said first and third contact side walls to one of a plurality of spatial intervals so as to allow said partitioning member to support said second rolled paper or a third rolled paper whose width is narrower than that of said second rolled paper.

In the invention, the partitioning member is positioned at several positions within the rolled-paper holder. Accordingly, the rolled-paper holder may be set to accept plural types of rolled papers by using only one partitioning member.

Further, the coupling mechanism preferably includes a snap-fitting mechanism.

Also in the invention, the partitioning member preferably includes an elastic contact portion of said third contact bottom portion, wherein said elastic contact portion is partially separated from said third contact side wall, said coupling mechanism further including an engaging hook on said elastic contact portion, and said rolled-paper holder includes an engaging part which contacts said engaging hook when said partitioning member is inserted in said rolled-paper holder.

In the invention, the elastic contact portion of the third contact bottom portion of the partitioning member is elastically engaged with the rolled-paper holder. Accordingly, the partitioning member may easily be set into the rolled-paper holder by merely pushing the partitioning member therein. Further, the third contact bottom portion of the partitioning member may be brought into close contact with the rolled paper-holder.

In the invention, the coupling mechanism includes a lower engaging portion that connects said bottom wall and said partitioning member, and upper engaging portion that connects said second contact side wall and said partitioning member. Further, the upper engaging portion of the coupling mechanism includes a protruded part protruding from the upper end of the second contact side wall of the rolled-paper holder, and a hole on the partitioning member that is coupled with the protruded part. Such mechanical arrangements are preferable to fix a posture of the partitioning member or to secure an easy setting of the partitioning member.

The partitioning member is made of transparent material. By so doing, the user can visually confirm the engaging locations through the partitioning member. This greatly contributes to the increase of efficiency when inserting the partitioning member into the rolled-paper holder.

The partitioning member preferably includes a widthwise movement contacting portion that sets a predetermined width between the first and third contact side portions when it comes in contact with a guide face that is parallel to the first contact side wall and that is provided on the second contact side wall.

Therefore, when the partitioning member is set into the rolled-paper holder while the widthwise movement contacting portion is brought into contact with the guide surface, the partitioning member may be set to a predetermined location where the second rolled paper or third rolled paper may be supported. This feature greatly contributes to the increase of efficiency.

In the invention, the widthwise movement contacting portion includes a first widthwise movement contacting portion and a second widthwise movement contacting portion, said first widthwise movement contacting portion is formed on the side of said third contact side wall that is opposite to said third bottom portion, wherein the first widthwise movement contacting portion may come in contact with said second contact side wall, said second widthwise movement contacting portion is shorter than said first widthwise movement contacting portion, and said first widthwise movement contacting portion is separable from said third contact side wall. In this case, the first widthwise movement contacting portion is provided with a groove formed near the third contact side wall to facilitate separation of the first widthwise movement contacting portion from the third contact side wall.

BRIEF DESCRIPTION OF THE DRAWINGS

The above and other objects and advantages of the present invention will become more apparent by describing in detail a preferred exemplary embodiment thereof with reference to the accompanying drawings, wherein like reference numerals designate like or corresponding parts throughout the several views, and wherein.

DETAILED DESCRIPTION OF THE PREFERRED EMBODIMENTS

The preferred embodiments of a printer according to present invention will be described with reference to the accompanying drawings.

Figure 1:
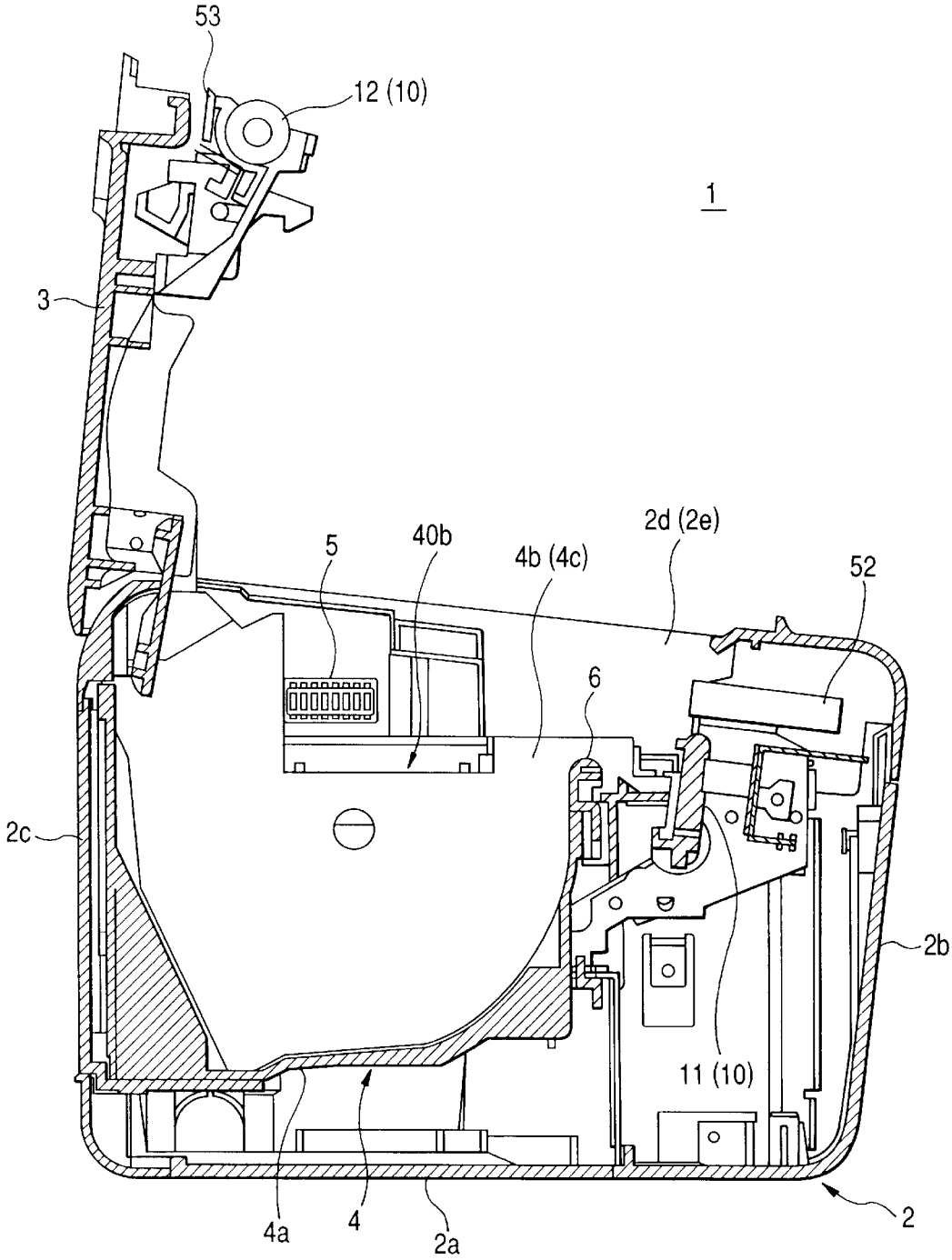
FIG. 1 is a side view schematically showing a printer, which is an embodiment of the present invention, wherein a rolled-paper cover is opened.
Figure 2:
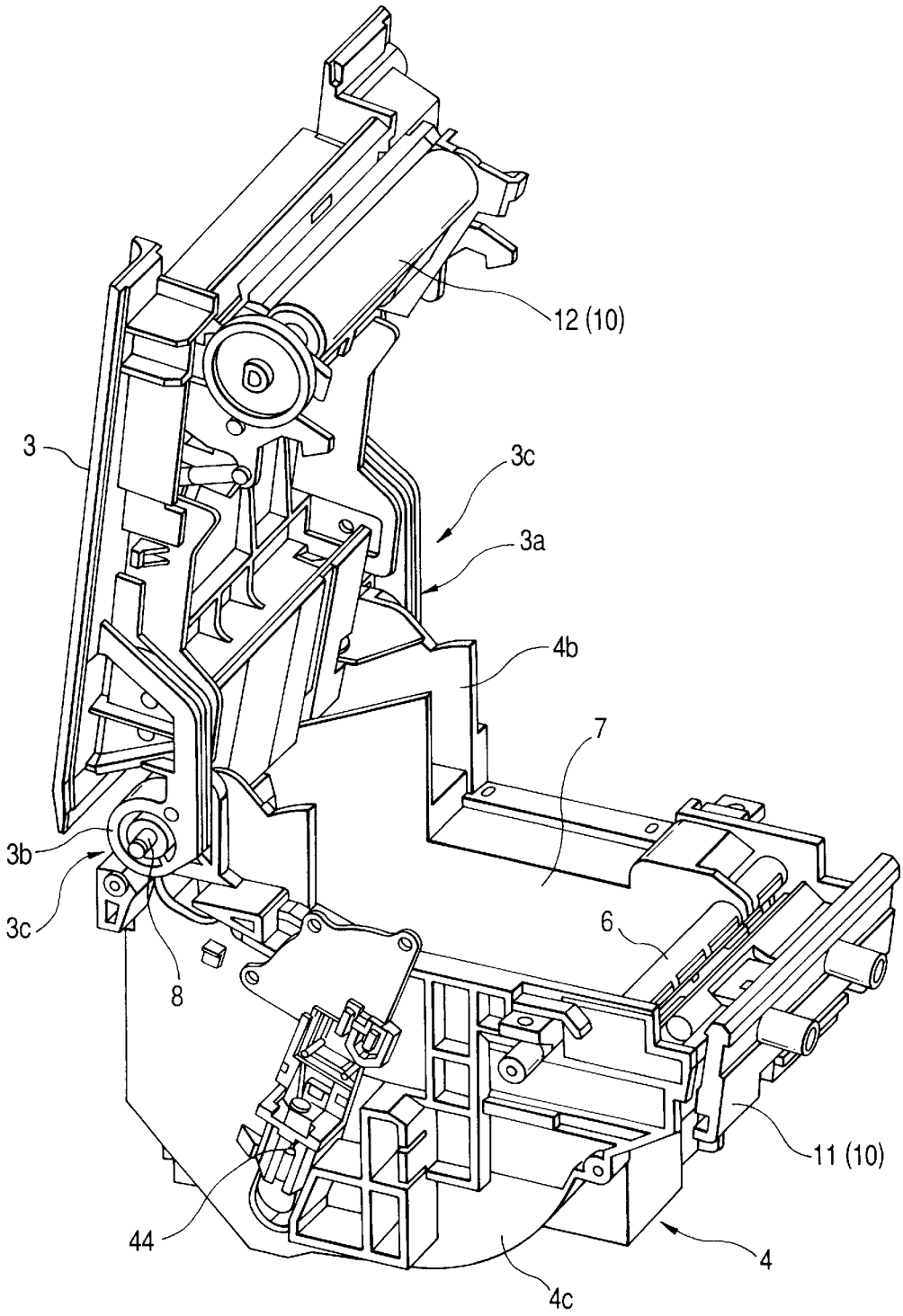
FIG. 2 is a perspective view schematically showing the printer in a state that the rolled-paper cover is opened.
Figure 3:
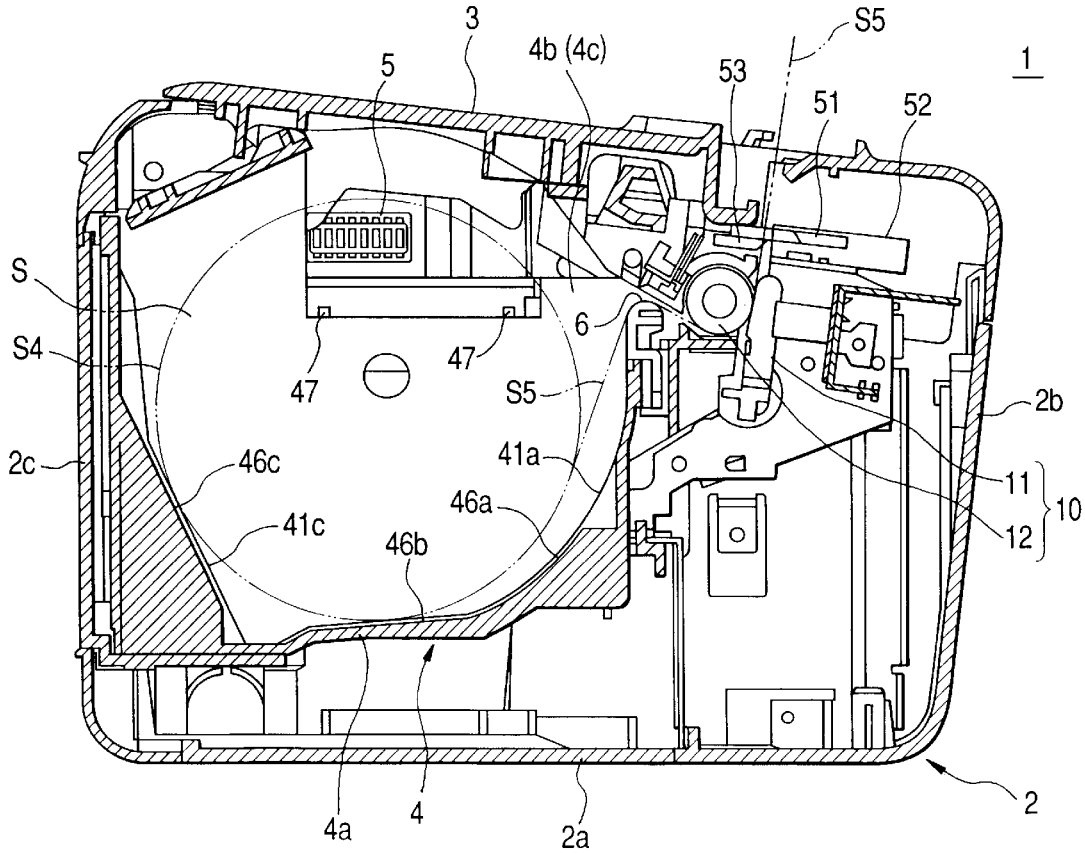
FIG. 3 is a side view schematically showing the printer in a state that the rolled-paper cover is closed.

FIG. 1 is a side view schematically showing a printer, which is an embodiment of the present invention, in a state that a rolled-paper cover is opened. FIG. 2 is a perspective view schematically showing the printer in a state that the rolled-paper cover is opened. FIG. 3 is a side view schematically showing the printer in a state that the rolled-paper cover is closed.

Figure 4A:
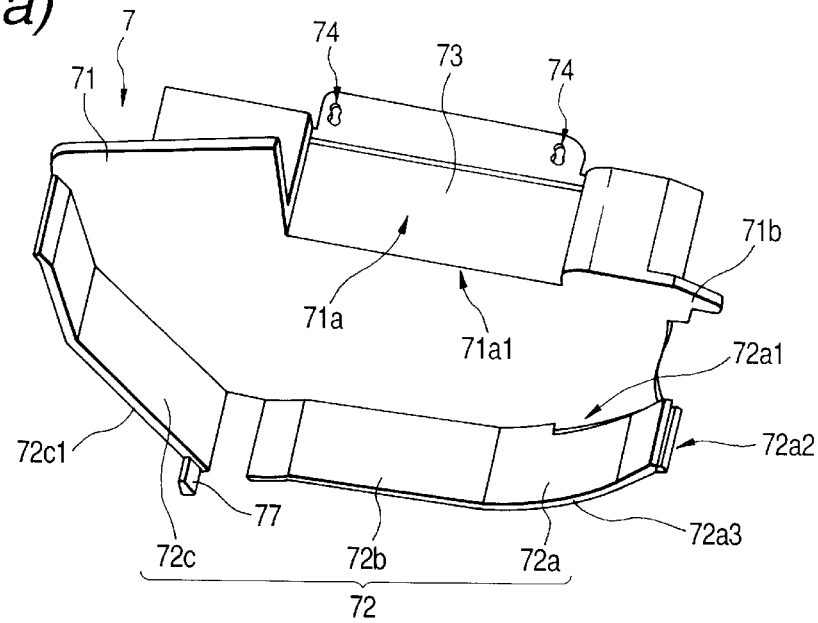
FIG. 4A is a perspective view schematically showing a partitioning member in accordance with an embodiment of the present invention.
Figure 4B:
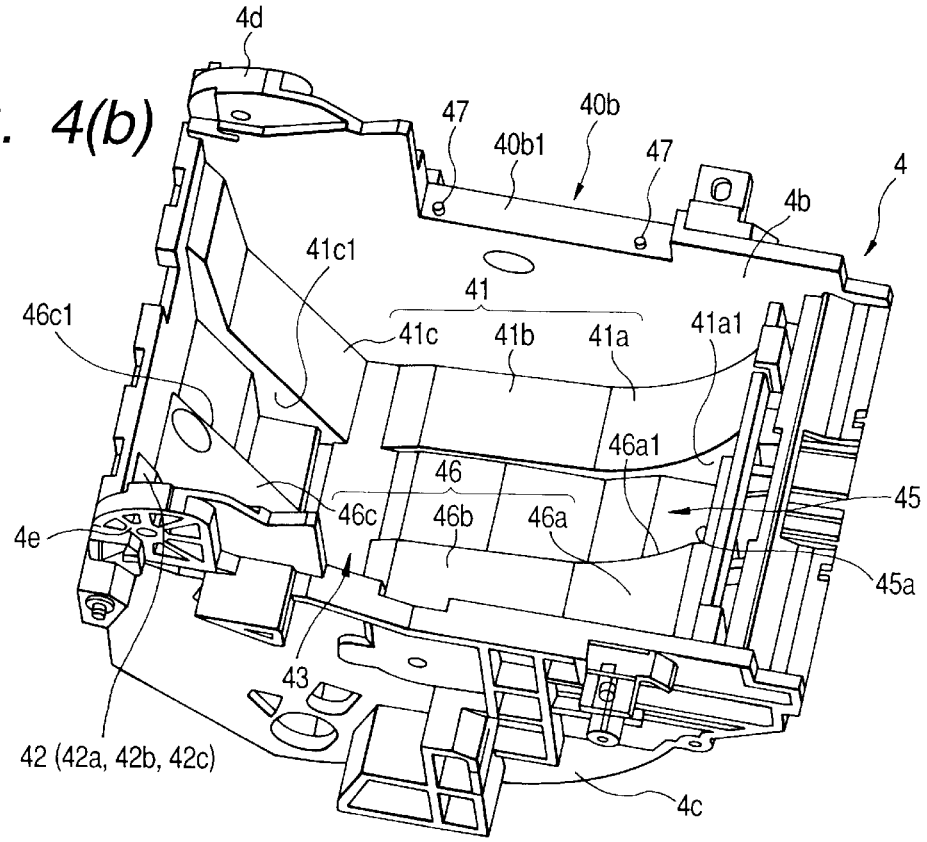
FIG. 4B is a perspective view schematically showing the rolled-paper holder in an embodiment of the present invention.

FIG. 4A is a perspective view schematically showing a partitioning member in the embodiment of the present invention. FIG. 4B is a perspective view schematically showing the rolled-paper holder in the embodiment.

Figure 5:
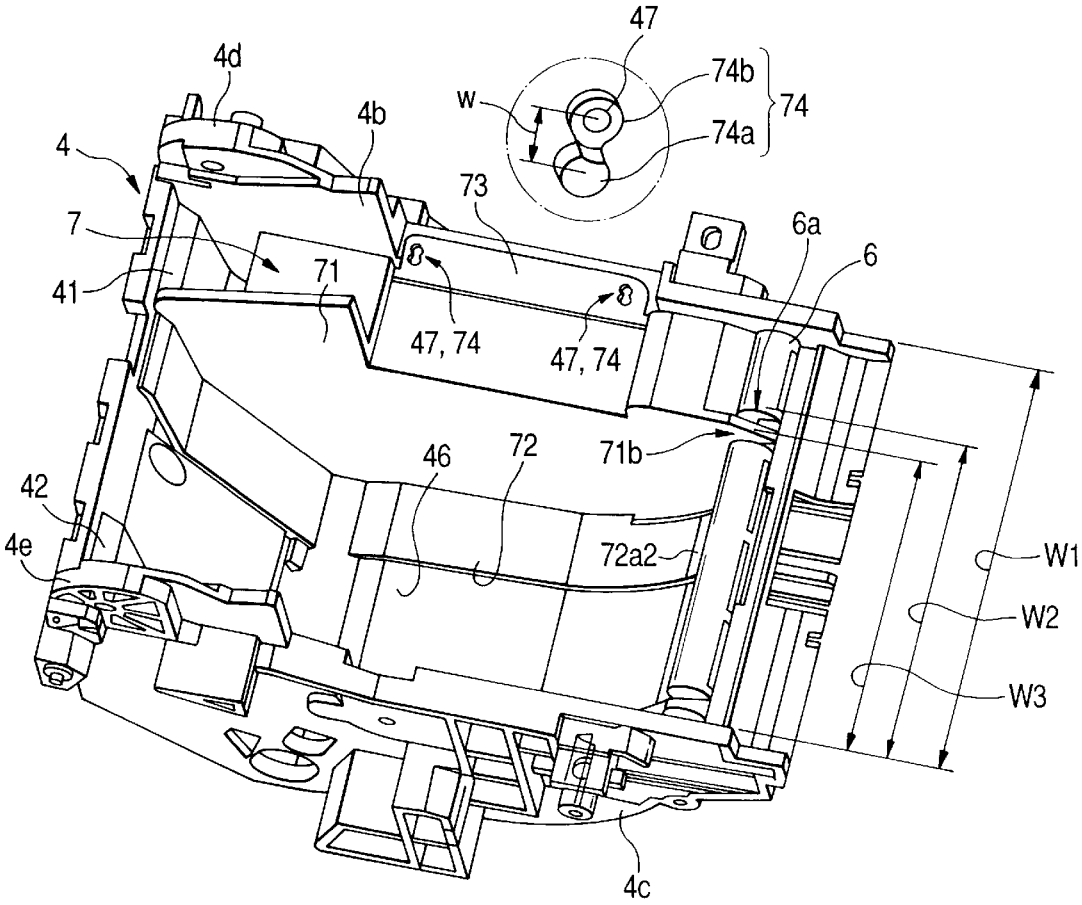
FIG. 5 is a perspective view showing the partitioning member mounted on the rolled-paper holder.

FIG. 5 is a perspective view showing the partitioning member being mounted on the rolled-paper holder.

As shown in FIG. 1, the printer, designated by reference numeral 1 includes a body case 2 with an opening and a rolled paper cover 3 for closing the opening of the body case. The body case 2 and the rolled-paper cover 3 are made of resin. The body case 2 takes the form of a cuboid having a rectangular bottom and a wall that is formed while surrounding the bottom. The rolled-paper cover 3 takes the form of a rectangular plate.

The printer 1 of the embodiment may be installed vertically or horizontally. In FIG. 1, the printer 1 is illustrated as horizontally installed. In the illustration, the bottom of the body case 2, when the printer 1 is horizontally installed, is referred to as a first installation portion 2*a*. A portion of the wall of the body case 2, which corresponds to the front side (the right side in FIG. 1) of the body case in this state of the printer installation, will be referred to as a front portion 2*b*. A wall portion of the rear side of the body case 2 will be referred to as a second installation portion 2*c* since the rear wall serves as the bottom of the body case when the printer 1 is vertically installed.

In this state of the printer installation, a wall portion of the left side (as the body case 2 is viewed from the front portion in FIG. 1) will be referred to as a first sidewall 2*e*. A wall portion of the right side (as the body case 2 is viewed from the front portion in FIG. 1) of the body case 2 will be a second side wall 2*d*. In the description to follow, for convenience only and not by way of limitation, the words expressing directions and orientations, such as upper, lower, front, and rear, will be used with reference to the printer 1 installed such that the body case 2 is located with its first installation portion 2*a* as the bottom.

As shown in FIG. 1 or 3, a rolled-paper holder 4, for containing a rolled sheet or sheets S, is provided within the body case 2. The rolled-paper holder 4 is made of resin, is shaped like a box, and includes a bottom wall 4*a* and side walls (4*b*, 4*c*). of those side walls, the side wall that faces the first side wall 2*e* will be referred to as a first contact side wall 4*c*. The side wall which faces the second side wall 2*d* of the body case 2 will be referred to as a second contact side wall 4*b*.

As shown in FIG. 4B or 5, the bottom wall 4*a*—of the rolled-paper holder 4—is shaped to have a concave surface whose width is somewhat wider than a width W1 (e.g., 80 mm) of a predetermined roll of paper.

In the end portion of the bottom wall 4*a* that is closer to the second contact side wall 4*b*, a second contact bottom portion 41, of a predetermined width L (see FIG. 8*a*), is provided so as to be in contact with one end of an outer surface S1 of the rolled paper S. The second contact bottom portion 41 includes a front contact part 41*a*, a lower contact part 41*b*, and a rear contact part 41*c*. The front contact part 41*a* ranges from the front side of the second contact bottom portion 41 to the mid position of the bottom, while being curved at a predetermined curvature. The lower contact part 41*b* is continuously, and somewhat downwardly, extended from the end of the front contact part 41*a*. The rear contact part 41*c* is extended from the rear upper side of the rolled-paper holder 4 downward to a position spaced from the end of the lower contact part 41*b* by a predetermined distance.

In the end portion of the bottom wall 4*a* that is closer to the first contact side wall 4*c*, a first contact bottom portion 42, which has a width L equal to that of the second contact bottom portion 41 (see FIG. 8*a*), is provided so as to be in contact with the other end of the outer surface S1 of the rolled paper S. The first contact bottom portion 42 includes front, lower and rear contact parts (42*a*, 42*b*, 42*c*), which are substantially the same in shape as those 41*a*, 41*b* and 41*c* of the second contact bottom portion 41, and which are located at the same positions as those of the latter when viewed in the circumferential direction of the bottom wall 4*a* of the rolled-paper holder 4.

A groove 43, which supports a rolled paper S of the small diameter or which supports the core (not shown) of the rolled paper S, is formed between the lower contact parts 42*b*, 41*b* and the rear contact parts 42*c*, 41*c* of the first and second contact bottom portions 42 and 41, which are contained in the bottom wall 4*a* of the rolled-paper holder 4.

When the rolled paper S is provided in the rolled-paper holder 4 and is dispensed therefrom, it is wound back, it rolls backward and is supported by the rear contact parts 42*c*, 41*c* and the lower contact parts 42*b*, 41*b*. When the diameter of the rolled paper S is small, and a recording sheet S5 is continuously transported as in a line thermal printer, it sometimes happens that the rolled paper S moves on the lower contact parts 42*b*, 41*b* in the sheet transporting direction, viz., it is not wound back. In this case, the rolled paper S comes in contact with the front contact parts 42*a*, 41*a*, and then is rotated while being wound back.

As shown in FIG. 2, a remaining-sheet detector 44, which detects that an amount of the rolled paper left is small, is provided on the first contact side wall 4*c* of the rolled-paper holder 4. The remaining-sheet detector 44 is selectively set to the printer in accordance with the horizontal installation or vertical installation of the printer 1.

As shown in FIG. 4B, between the first contact bottom portion 42 and the second contact bottom portion 41 of the rolled-paper holder 4, a first bottom portion 45 and a second bottom portion 46 are provided so that they are lower than the first contact bottom portion 42 and the second contact bottom portion 41, in order to avoid contact with the rolled paper S.

The first bottom portion 45 is located adjacent to the second contact bottom portion 41, has a predetermined width, and is thinner than the bottom portions of the first contact bottom portion 42 and the second contact bottom portion 41. Side surfaces 41*a*1 and 41*c*1 of the front contact part 41*a* and the rear contact part 41*c* are formed in parallel to the first contact side wall 4*c* and the second contact side wall 4*b*.

The rear side of the groove 43 is bored and an engaging edge 45*b* is formed thereat. See FIG. 7. An engaging ridge 78 of a partitioning plate 7 (to be described later) engages the engaging edge part 45*b*. Provided on the groove 43, in the vicinity of the opening, is a positioning protrusion 43*a* that engages the partitioning member 7 for positioning that partitioning member 7 in the width direction.

The second bottom portion 46 has a predetermined width, and is located between the first bottom portion 45 and the first contact bottom portion 42. The second bottom portion 46 includes front, lower and rear contact parts (46*a* 46*b* 46*c*), which are substantially the same in shape as those 42*a*, 41*a*, 42*b*, 42*c*, 41*b*, 41*c*, and 42*c*, 41*c* of the first and second contact bottom portions 42 and 41, but are thinner than those of the first and second contact bottom portions 42 and 41 by a predetermined thickness. As a result, the second bottom portion 46 and the first contact bottom portion 42 are stepwise juxtaposed in predetermined depths.

The first contact side wall 4*c* and the second contact side wall 4*b* are semicircular plates, and are disposed in parallel with each other so as to be brought into contact with part of the side faces of the rolled paper S. As shown in FIG. 1, a DIP switch 5—used for predetermined settings—is provided between the second side wall 2*d* of the body case 2 and the second contact side wall 4*b* of the rolled-paper holder 4. A recess 40*b*, larger in size than the DIP switch 5, is formed in the second contact side wall 4*b* of the rolled-paper holder 4.

As shown in FIG. 3 or 5, a tension member 6 is provided at the top end of the bottom wall 4*a* so that the tension member 6 extends along the width direction of the rolled-paper holder 4.

Figure 6A:
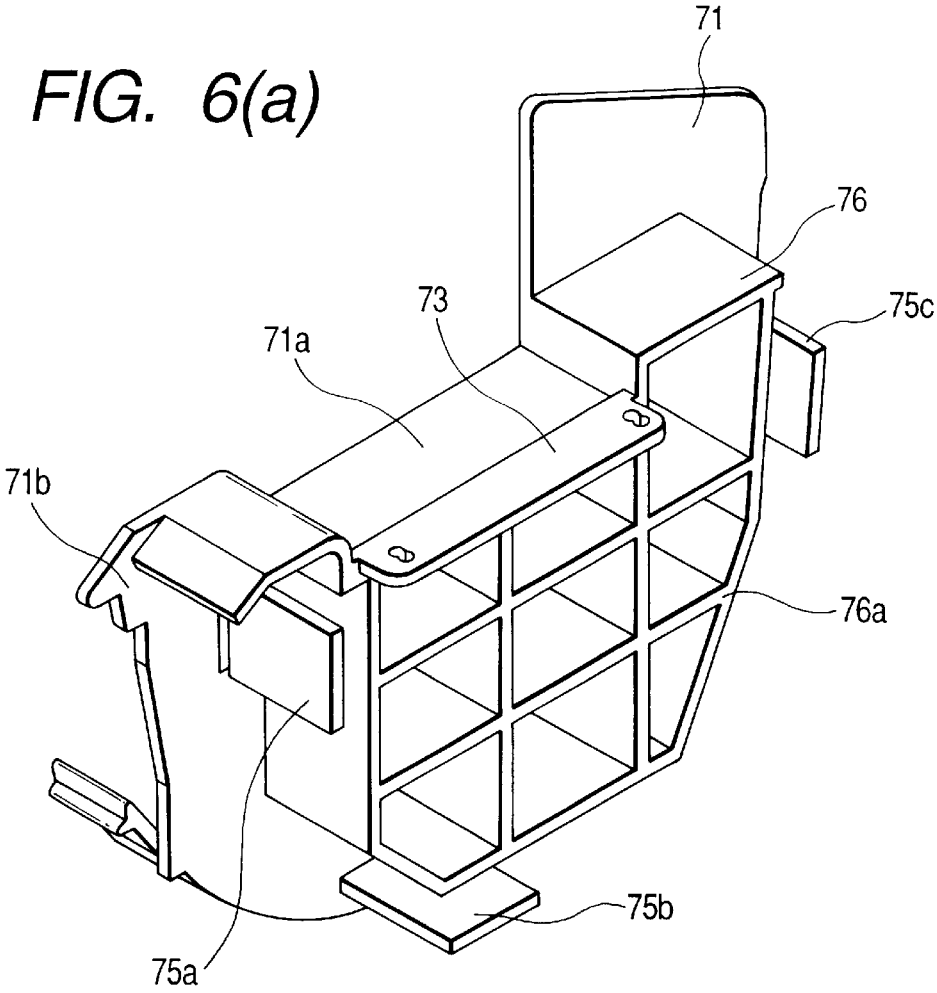
FIG. 6A is a perspective view showing a partitioning member when viewed from the second contact side.
Figure 6B:
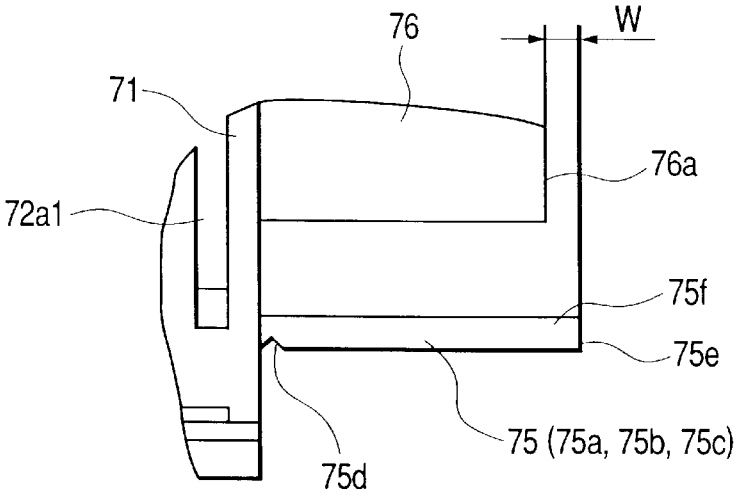
FIG. 6B is a view showing a widthwise movement contacting portion of the partitioning member.
Figure 7:
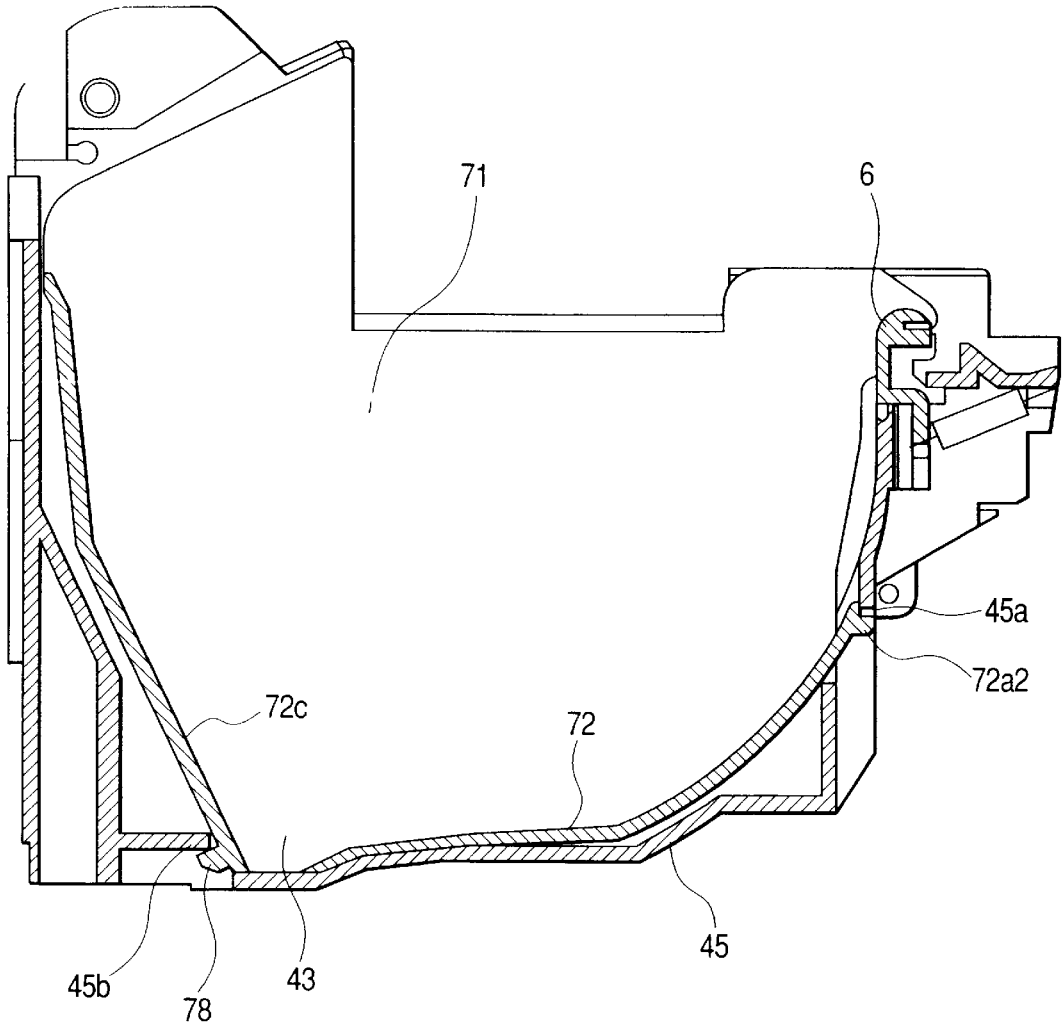
FIG. 7 is a sectional view showing the mounting of the partitioning member when viewed in cross section of the partitioning member.
Figure 8A:
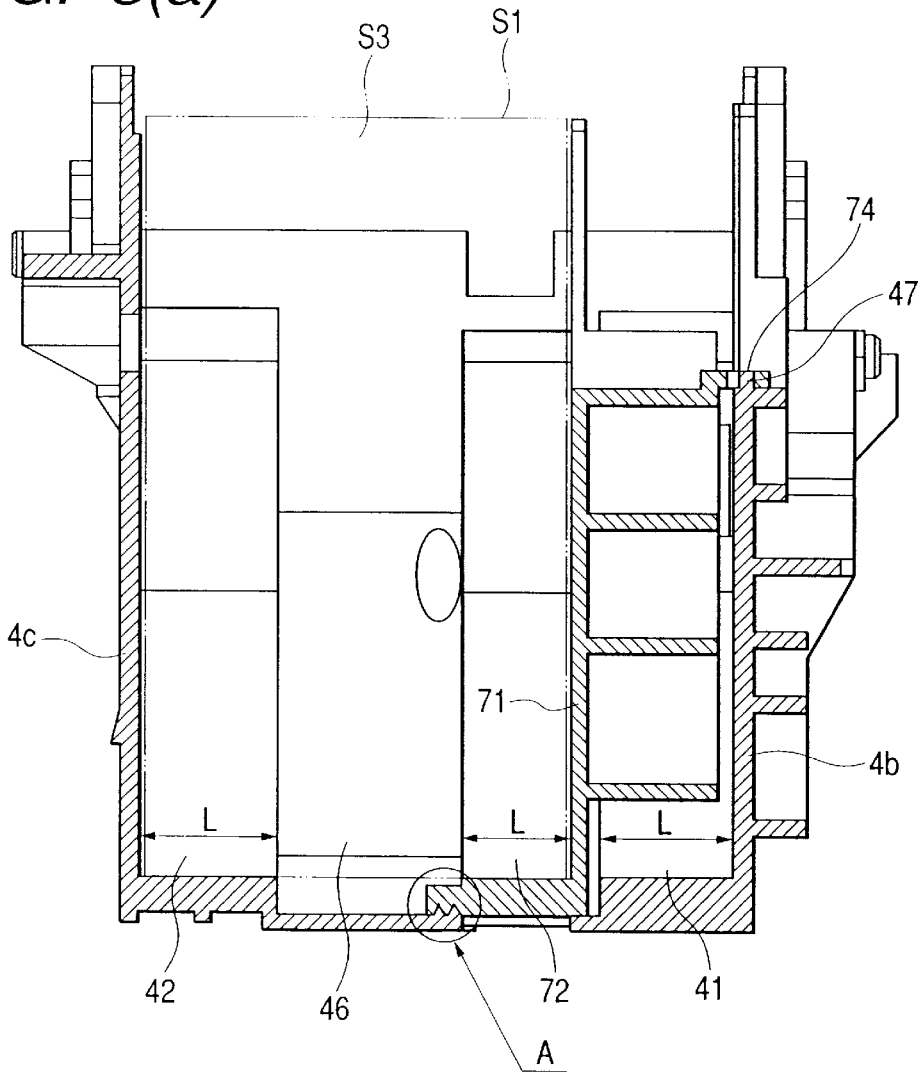
FIG. 8*a* is a view showing the mounting of the partitioning member when viewed in the width direction of the partitioning member.
Figure 8B:
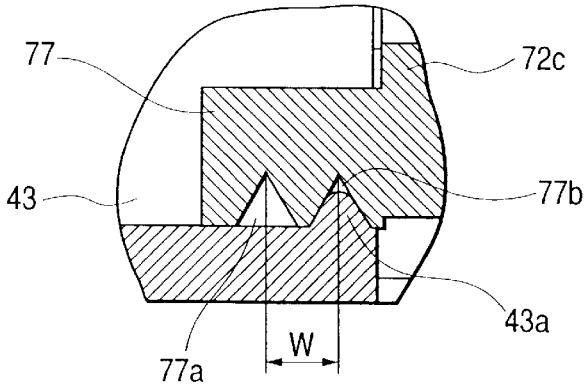
FIG. 8*b* is a blown-up view of an engagement between the partitioning member and the rolled-paper holder.

The partitioning member will now be described with reference to FIGS. 4A and 6 to 8. FIG. 6A is a perspective view showing a partitioning member when viewed from the second contact side. FIG. 6B is a view for explaining a widthwise movement contacting portion 75. FIG. 7 is a sectional view for explaining the mounting of the partitioning member when viewed in the cross section of the member. FIG. 8*a* is a view for explaining the mounting of the partitioning member when viewed in the width direction of the member.

The printer 1 of the present embodiment includes the partitioning member 7 detachably attached to the rolled-paper holder 4. The partitioning member 7 is made of such resin as polycarbonate, and is formed with a third contact side portion 71, a third contact bottom portion 72 and a coupling portion 73.

The third contact side portion 71 includes a semicircular plate. A recess 71*a*, which is similar in shape to the second contact side wall 4*b* of the rolled-paper holder 4, is formed in the third contact side portion 71 at a predetermined location. A hook-like piece 71*b* is formed at the top end of the third contact side portion 71. As shown in FIG. 5, the tension member 6 includes a groove 6*a* into which the hook-like piece 71*b* will be inserted.

As shown in FIG. 4A, the third contact bottom portion 72 is shaped like a strip, and extends from the peripheral edge of the third contact side portion 71 in a direction orthogonal to the third contact side portion 71. The width of the third contact bottom portion 72 is equal to that of the second contact bottom portion 41.

The inner surface of the third contact bottom portion 72 resembles, in shape, the second contact bottom portion 41. To be more specific, the third contact bottom portion 72 includes a front 10 contact portion (resilient contact portion) 72*a*, a lower contact portion 72*b*, and a rear contact portion 72*c*. The front contact portion 72*a* is curved at a predetermined curvature. The lower contact portion 72*b* is shaped like a planar plate, and is continuous to the end of the front contact portion but somewhat slanted downward. The rear contact portion 72*c* is shaped like a planar plate, is extended to a position that is spaced from the end of the lower contact portion by a predetermined distance, and is slated downward from the rear upper side.

Thickness values of the respective portions of the third contact bottom portion 72 are selected so that when the third contact bottom portion 72 comes in contact with the first bottom portion 45 of the rolled-paper holder 4, the upper surfaces of the third contact bottom portion 72 and the first contact bottom portion 42 of the rolled-paper holder 4 are flush with each other, so that the third contact bottom portion 72 and the first contact bottom portion 42 are brought into contact with the both ends of the outer surface S1 of rolled paper S3.

A groove 72*a*1 is formed in a front part of the front contact portion 72*a* so as to part it from the third contact side portion 71. The groove 72*a*1 makes the front contact portion 72*a* elastically displaceable. An engaging hook 72*a*2 is formed at the end of the front contact portion 72*a*.

As shown in FIG. 4B, an engaging part 45*a* is formed at the fore end of the first bottom portion 45 of the rolled-paper holder 4. The engaging part 45*a* will engage the engaging hook 72*a*2 of the front contact portion 72*a* of the partitioning member 7. As shown in FIG. 4A, the coupling portion 73 is formed with a rectangular planar plate of a predetermined size. The coupling portion 73, which includes a bottom portion 71*a*1 of the recess 71*a*, extends orthogonally to the third contact side portion 71. The coupling portion 73 is located opposite to the third contact bottom portion 72. The end portions of the coupling portion 73 are sized so as to engage the bottom portion of the recess 40*b* of the rolled-paper holder 4. As shown in FIG. 5, engaging portions 74 are spaced from each other by a predetermined distance, and are formed at locations close to the edge of the coupling portion 73. Each of the engaging portions includes a pair of circular holes 74*a* and 74*b* whose centers are spaced from each other by a gap W so that the holes 74*a* and 74*b* are coupled together.

A lower positioning piece 77 is formed on the rear contact portion 72*c*. The lower positioning piece includes two V-grooves 77*a* and 77*b*, which are separated from each other by a distance equal to the gap W. See FIGS. 8*a* and 8*b*. As shown in FIG. 7, an engaging ridge 78 is raised on the rear side of the rear contact portion 72*c*, and extends over the entire width of the rear contact portion 72*c*.

As shown in FIGS. 6*a* and 6*b*, a first widthwise movement contacting portion 75 (75*a*, 75*b*, 75*c*) is formed on the side of the third contact side portion 71 that is in opposition to the third contact bottom portion 72. Further, there is provided a second widthwise movement contacting portion 76, which is shorter than the first widthwise movement contacting portion 75 by a distance equal to the width W on each engaging portion 74. A V-groove 75*d* is formed at the root of the first widthwise movement contacting portion 75. Provision of the V-grooves 75*d* allows the first widthwise movement contacting portion 75 to be separated from the third contact side portion 71. When the top end 75*f* of the first widthwise movement contacting portion 75 is displaced to a region including its side not having the V-groove 75*d* formed therein, stress concentrates on the V-groove 75*d*, the first widthwise movement contacting portion 75 is bent at the V-grooves 75*d*, and its top end 75*f* is separated from the partitioning member 7.

As shown in FIG. 4A, engaging protrusions 47, which may engage the circular holes 74*a* and 74*b* of the engaging portions 74, are provided on a bottom portion 40*b*1 of the recess 40*b* of the second contact side wall 4*b* of the rolled-paper holder 4. In the partitioning member 7, the engaging portions 74 of the coupling portion 73 are positioned relative to the third contact side portion 71 such that the third contact side portion 71 may be brought into contact with the side face of a rolled paper S having two width values W2 (60 mm, for example) and W3 (58 mm, for example)—so as to allow the rolled-paper holder 4 to hold the rolled paper by itself, each of those width values being smaller than the width value W1—in a state that a slight gap is present between the third contact side portion 71 and the first contact side wall 4*c* of the rolled-paper holder 4.

As shown in FIG. 4B, bearings 4*e* and 4*d* are respectively provided at the ends of the rear portions of the first contact side wall 4*c* and the second contact side wall 4*b* of the rolled-paper holder 4. As shown in FIG. 2, bearings 3*a* and 3*b* respectively are provided at both ends of the rear portion of the rolled-paper cover 3. Support pins 8 respectively are inserted through the bearings 3*a* and 3*b*, and the bearings 4*d* and 4*e* of the rolled-paper holder 4, and bearings (not shown) of the body case 2, thereby forming a hinge 3*c* of the rolled-paper cover 3. Thus, the rolled-paper cover 3 is hingedly supported on the body case 2.

As shown in FIG. 1 or 3, a line thermal head 11 is provided between the tension member 6 of the rolled-paper holder 4 and the front portion 2*b* of the body case 2. A platen roller 12 is rotatably provided on the top end of the rolled-paper cover 3. When the rolled-paper cover 3 is closed, the platen roller 12 comes in contact with the line thermal head 11. The line thermal head 11 and the platen roller 12 form a print mechanism 10. The platen roller 12 is rotated by a pulse motor (not shown).

As shown in FIG. 1 or 3, a movable blade device 52, which is constructed so as to move a movable blade 51, is provided in the upper part of the line thermal head 11. A fixed blade 53 is provided at a predetermined location of the top end portion of the rolled-paper cover 3. When the rolled-paper cover 3 is closed, the fixed blade 53 is disposed opposite to the movable blade 51 so that the movable blade 51 slides thereon.

In the embodiment thus constructed, when the rolled paper S of the width W1 is used, the rolled paper S is loaded into the rolled-paper holder 4 without using the partitioning member 7. In this case, the rolled paper S is supported at both ends of its outer surface S1 by the first contact bottom portion 42 and the second contact bottom portion 41. The first contact side wall 4*c* and second contact side wall 4*b* of the rolled-paper holder 4 come in contact with both side faces of the rolled paper S, thereby contacting the rolled paper from moving in the width direction.

To print, the platen roller 12 is rotated and a recording sheet S5 is rolled out of the rolled paper S, by rotating the rolled paper S. At this time, the outer surface S1, i.e., the heat sensitive side of the recording sheet, is brought into contact with only parts of the first contact bottom portion 42 and the second contact bottom portion 41 of the rolled-paper holder 4. Accordingly, the side of the rolled paper S that is coated with the heat sensitive material is not damaged.

When the rolled paper of the width W3 is used, the partitioning member 7 is set in the rolled-paper holder 4.

The work of setting the partitioning member 7 in the rolled-paper holder 4 will now be described in detail. The partitioning member 7 is located close to the second contact side wall 4*b*, and its engaging ridge 78 is engaged with the engaging edge part 45*b* while the end face 74*e* of the first widthwise movement contacting portions 75*a*, 75*b* and 75*c* are brought into contact with the second contact side wall 4*b*. Then, the partitioning member 7 is forcibly pushed into the bottom wall 4*a* of the rolled-paper holder 4. At this time, the bottom surface of the third contact bottom portion 72 covers the first bottom portion 45 of the rolled-paper holder 4. With respect to the coupling portion 73, the bottom portion 40*b*1 of the recess 40*b* of the rolled-paper holder 4 is in contact with the bottom portion 71*a*1 of the recess 71*a* of the partitioning member 7.

Thereafter, the partitioning member 7 is forcibly pushed so as to reduce the radius of curvature of the front contact portion 72*a* to engage the engaging hook 72*a*2 with the engaging part 45*a* of the rolled-paper holder 4. As a result, the partitioning member 7 is fixed in the rolled-paper holder 4 in a state that the third contact bottom portion 72 presses the first bottom portion 45 of the rolled-paper holder 4.

Through the above-described steps of the setting work, the V-groove 77*b* of the lower positioning piece 77 receives the positioning protrusion 43*a*. With respect to the engaging portions 74 of the coupling portion 73, the circular holes 74*b* located in the outer part as viewed from the third contact side portion 71 receive the engaging protrusions 47 of the second contact side wall 4*b* of the rolled-paper holder 4. The partitioning member 7 is positioned at two positions in the upper part and at one position in the lower part when horizontally viewed. The third contact side portion 71 of the rolled-paper cover 3 is mounted parallel to the first contact side wall 4*c*.

In this case, the first widthwise movement contacting portion 75 is brought into contact with the second contact side wall 4*b* to prohibit the movement of the partitioning member 7 to the second contact side wall 4*b*. Therefore, in this case, the V-groove 77*a* of the lower positioning piece 77 can not receive the positioning protrusion 43*a*, and the circular hole 74*a* can not receive the engaging protrusions 47. Thus, the rolled-paper holder is set to be ready for accepting the rolled paper of the width W3 by merely setting the partitioning member 7 into the rolled-paper holder 4 while pressing it against the second contact side wall 4*b*. Accordingly, the setting-work efficiency is improved.

Thereafter, the rolled paper S3 of the width W3 is placed in a space enclosed by the partitioning member 7 within the rolled-paper holder 4. In this case, the end of the outer surface S1 of the rolled paper S3 that is located opposite to the end supported by the first contact bottom portion 42 and the first contact side wall 4*c* of the rolled-paper holder 4, is supported by the third contact bottom portion 72 and the third contact side portion 71 of the partitioning member 7. Accordingly, the rolled paper S3 and the recording sheet rolled out of the rolled paper are supported in a manner similar to that as when supported by the rolled-paper holder 4 itself, not using the partitioning member 7.

Next, a case where the rolled-paper holder is set to be ready for accepting the rolled paper of the width W2 will be described, wherein W2 is greater than W3. In this case, the first widthwise movement contacting portions 75*a*, 75*b* and 75*c* of the partitioning member 7 are displaced to a region including their side not having the V-grooves 75*d* formed therein. By so displacing the first widthwise movement contacting portions 75*a*, 75*b*, and 75*c*, they are separated from the partitioning member 7 by bending them. Subsequently, the engaging ridge 78 of the partitioning member 7 is engaged with the engaging edge part 45*b*, and the end face 76*a* of the second widthwise movement contacting portion 76 is brought into contact with the second contact side wall 4*b*. Then, the partitioning member 7 is pushed toward the bottom wall 4*a* of the rolled-paper holder 4. The subsequent procedural steps of the setting work are substantially the same as in the case where the rolled-paper holder is set to accept the rolled paper of the width W3.

Through those steps of the setting work, the partitioning member 7 is guided by the second widthwise movement contacting portion 76. Accordingly, it is moved near the second contact side wall 4*b* by a distance of the set width W, as compared with the case where it is guided by the first widthwise movement contacting portion 75. Accordingly, the positioning protrusion 43*a* engages the V-groove 77*a* of the lower positioning piece 77. The engaging protrusions 47 of the rolled-paper holder 4 engage the circular holes 74*a* of the engaging portions 74. As a result, the rolled-paper holder 4 is set to accept the rolled paper of the width W2.

As described above, in this case, the third contact side portion 71 of the partitioning member 7 is positioned in a state that it is kept parallel to the first contact side wall 4*c* of the rolled-paper holder 4. The third contact bottom portion 72 (like the second contact bottom portion 41) supports the outer surface S1 of the rolled paper together with the first contact bottom portion 42. Accordingly, if the outermost sheet of the rolled paper is loosened, the problem by the nipping of the recording sheet does not arise since no gap is present between the contact bottom portion of the partitioning member and the contact side wall. Accordingly, the rolled-paper holder 4 is capable of stably supporting rolled papers—having different width values W1, W2, W3—whether or not the partitioning member 7 is used.

In general, in the above-described embodiment of the present invention, the front contact portion 72*a* of the third contact bottom portion 72 is elastically deformed and engaged with the rolled-paper holder 4. Accordingly, the partitioning member 7 may be set to the rolled-paper holder 4 by merely pushing the partitioning member 7 therein. With its elastic force, the partition member 7 is reliably installed to the rolled-paper holder 4 while being pressed against the rolled-paper holder 4. To remove the partitioning member 7, the tip of a screwdriver is applied to the place at which the engaging hook 72*a*2 is engaged with the engaging part 45*a* so as to disengage these parts one another. Then, the partitioning member 7 is automatically raised by its elastic force. Accordingly, the partitioning member 7 may be removed easily.

Further, in the above-described embodiment, the partitioning member 7 is positioned at several positions to the rolled-paper holder 4. Accordingly, the rolled-paper holder 4 may be set to accept plural types of rolled papers by using one partitioning member 7.

Further, the partitioning member 7 may be transparent. This feature brings about the following advantage. In a case where the rolled-paper holder is set for the rolled paper of the width W2 by bending the first widthwise movement contacting portions 75*a*, 75*b* and 75*c* and removing them from the partitioning member 7, and then the rolled-paper holder is set for the rolled paper of the width W3, it is easy to engage the V-groove 77*b* with the positioning protrusion 43*a*, and to engage the circular hole 74*b* of the engaging portions 74 with the engaging protrusions 47. That is, the engagement of these parts can easily be confirmed by eye.

It should be understood that the present invention is not limited to the above-mentioned embodiment, but may variously be modified, altered and changed within the scope of the invention.

In the above-mentioned embodiment, the engaging portions 74 of the partitioning member 7 are designed so as to determine two positions of the partitioning member. If required, those engaging portions 74 may be designed so as to determine three or more positions of the partitioning member. By doing so, the number of rolled-paper types that the rolled-paper holder 4 can hold may be increased.

To set the partitioning member 7 into the rolled-paper holder to accommodate rolled-paper of the width W3, the first widthwise movement contacting portion 75 is brought into contact with the second contact side wall 4*b*. In this case, the side surfaces 41*a*1 and 41*c*1 of the second contact bottom portion 41 may be used as guide surfaces. Further, to set the rolled-paper holder 4 for the rolled paper of width W2, the second contact bottom portion 41 is brought into contact with the side of the third contact side portion 71 that is opposite to the third contact bottom portion 72. To set the rolled-paper holder 4 for the rolled paper of a fourth width W4, the side faces 72*c*1 and 72*a*3 of the third contact bottom portion 72 may be brought into contact with the side faces 46*a*1 and 46*c*1 of the second bottom portion 46.

Effect of the Invention

As seen from the foregoing description, the rolled-paper holder is able to support rolled papers of different sheet widths in like and stable states whether or not the partitioning member is used for setting the rolled papers in the rolled-paper holder.

In the invention, the third contact bottom portion of the partitioning member is elastically engaged with the rolled-paper holder. Accordingly, the partitioning member may easily be set to the rolled-paper holder by merely pushing the partitioning member therein.

Additionally, the partitioning member is positioned to contact the rolled-paper holder at several points. Therefore, plural types of rolled papers may be accommodated by the rolled-paper holder and only one partitioning member.

What is claimed is:

1. A printer comprising:

a print mechanism for printing characters on a recording sheet rolled out of a rolled paper;

a rolled-paper holder including a bottom wall having a first contact bottom portion and a second contact bottom portion that support a first rolled paper while being in contact with a part of a circumferential outer surface of said first rolled paper and, a first contact side wall and a second contact side wall, which are located on opposite sides of said bottom wall and which are substantially parallel to each other, wherein the first contact side wall and the second contact side wall may come in contact with a side face of said first rolled paper;

a partitioning member being locatable between said first contact side wall and said second contact side wall of said rolled-paper holder, said partitioning member includes a third contact side wall which may come in contact with a second rolled paper whose width is narrower than that of said first rolled paper, and a third contact bottom portion extending from said third contact side wall in a direction substantially perpendicular to said third contact side wall; and a coupling mechanism enabling said partitioning member to be set in said rolled-paper holder such that said first contact side wall and said third contact side wall are substantially parallel to each other while being spaced from each other by a predetermined distance.

2. A printer according to claim 1, wherein said coupling mechanism includes engaging portion which selectively set a spatial interval between said first and third contact side walls to one of a plurality of spatial intervals so as to allow said partitioning member to support said second rolled paper or a third rolled paper whose width is narrower than that of said second rolled paper.

3. A printer according to claim 2, wherein said partitioning member includes a widthwise movement contacting portion that sets a predetermined width between said first and third contact side walls when the widthwise movement contacting portion contacts with a guide face parallel to said first contact side wall, wherein said guide face is provided on said second contact side wall.

4. A printer according to claim 1, wherein said coupling mechanism includes a snap-fitting mechanism.

5. A printer according to claim 4, wherein said coupling mechanism is formed on said partitioning member and includes an elastic contact portion of said third contact bottom portion, wherein said elastic contact portion is partially separated from said third contact side wall, said coupling mechanism further including an engaging hook on said elastic contact portion, and said rolled-paper holder includes an engaging part which contacts said engaging hook when said partitioning member is inserted in said rolled-paper holder.

6. A printer according to claim 1, wherein said partitioning member is made of transparent material.

7. A printer comprising:

a print mechanism for printing characters on a recording sheet rolled out of a rolled paper;

a rolled-paper holder including a bottom wall having a first contact bottom portion and a second contact bottom portion that support a first rolled paper while being in contact with a part of a circumferential outer surface of said first rolled paper and, a first contact side wall and a second contact side wall, which are located on opposite sides of said bottom wall and which are substantially parallel to each other, wherein the first contact side wall and the second contact side wall may come in contact with a side face of said first rolled paper;

a partitioning member being locatable between said first contact side wall and said second contact side wall of said rolled-paper holder, said partitioning member includes a third contact side wall which may come in contact with a second rolled paper whose width is narrower than that of said first rolled paper, and a third contact bottom portion which is provided on said third contact side wall in a direction substantially perpendicular to said third contact side wall; and a coupling mechanism enabling said partitioning member to be set in said rolled-paper holder such that said first contact side wall and said third contact side wall are substantially parallel to each other while being spaced from each other by a predetermined distance, wherein said coupling mechanism includes a lower engaging portion that connects said bottom wall and said partitioning member, and upper engaging portion that connects said second contact side wall and said partitioning member.

8. A printer according to claim 7, wherein said upper engaging portion of said coupling mechanism includes a protruded part protruding from said second contact side wall of said rolled-paper holder, and a hole on said partitioning member, wherein said hole is coupled with said protruded part when said partitioning member is inserted in said rolled-paper holder.

9. A printer comprising:

a print mechanism for printing characters on a recording sheet rolled out of a rolled paper;

a rolled-paper holder including a bottom wall having a first contact bottom portion and a second contact bottom portion that support a first rolled paper while being in contact with a part of a circumferential outer surface of said first rolled paper and, a first contact side wall and a second contact side wall, which are located on opposite sides of said bottom wall and which are substantially parallel to each other, wherein the first contact side wall and the second contact side wall may come in contact with a side face of said first rolled paper;

a partitioning member being locatable between said first contact side wall and said second contact side wall of said rolled-paper holder, said partitioning member includes a third contact side wall which may come in contact with a second rolled paper whose width is narrower than that of said first rolled paper, and a third contact bottom portion which is provided on said third contact side wall in a direction substantially perpendicular to said third contact side wall; and a coupling mechanism enabling said partitioning member to be set in said rolled-paper holder such that said first contact side wall and said third contact side wall are substantially parallel to each other while being spaced from each other by a predetermined distance, wherein said partitioning member includes a widthwise movement contacting portion that sets a predetermined width between said first and third contact side walls when the widthwise movement contacting portion contacts with a guide face parallel to said first contact side wall, wherein said guide face is provided on said second contact side wall.

10. A printer according to claim 9, wherein said widthwise movement contacting portion includes a first widthwise movement contacting portion and a second widthwise movement contacting portion, said first widthwise movement contacting portion is formed on the side of said third contact side wall that is opposite to said third bottom portion, wherein the first widthwise movement contacting portion may come in contact with said second contact side wall, said second widthwise movement contacting portion is shorter than said first widthwise movement contacting portion, and said first widthwise movement contacting portion is separable from said third contact side wall.

11. A printer according to claim 10, wherein said first movement contacting portion includes a groove formed near said third contact side wall, thereby facilitating separation of said first widthwise movement contacting portion from said third contact side wall.

* * * * *

UNITED STATES PATENT AND TRADEMARK OFFICE

CERTIFICATE OF CORRECTION

PATENT NO. : 6,565,273 B2
DATED : May 20, 2003
INVENTOR(S) : Yamada

It is certified that error appears in the above-identified patent and that said Letters Patent is hereby corrected as shown below:

Title page, Item [54] and Column 1, line 1,
Delete "[54] PRINTER THAT ACCOMODATES ROLLED PAPER HAVING VARIOUS WIDTHS" and insert therefor
-- [54] PRINTER THAT ACCOMMODATES ROLLED PAPER HAVING VARIOUS WIDTHS --.

Signed and Sealed this

Twenty-seventh Day of January, 2004

JON W. DUDAS
*Acting Director of the United States Patent and Trademark Office*